United States Patent [19]

Canney et al.

[11] 4,205,290

[45] May 27, 1980

[54] TRANSFORMER CONSTRUCTION

[75] Inventors: Robert S. Canney, Berwick, Me.; Ronald J. Ouellette, Bedford; William H. Morong, Jr., Madbury, both of N.H.

[73] Assignee: General Electric Company, Somersworth, N.H.

[21] Appl. No.: 972,505

[22] Filed: Dec. 22, 1978

[51] Int. Cl.[2] ..... H01F 27/04

[52] U.S. Cl. ..... 336/90; D13/4; 336/96

[58] Field of Search ..... D13/4; 174/18; 336/96, 336/92, 94, 90, 105

[56] References Cited

U.S. PATENT DOCUMENTS

| | | | |
|---|---|---|---|
| D. 180,448 | 6/1957 | Kerr | D13/4 |
| 1,415,321 | 5/1922 | Eby | 174/18 |
| 1,777,072 | 9/1930 | Burnham | 174/18 |
| 1,794,750 | 3/1931 | Ainsworth | 174/18 |
| 2,997,526 | 8/1961 | Kessel et al. | 336/96 X |
| 3,073,891 | 1/1963 | Barengoltz | 174/161 R |
| 3,202,947 | 8/1965 | Budovec | 336/96 |
| 3,271,714 | 9/1966 | Cossaart | 174/18 X |

FOREIGN PATENT DOCUMENTS

| | | | |
|---|---|---|---|
| 419823 | 6/1924 | Fed. Rep. of Germany | 336/90 |
| 1513947 | 4/1969 | Fed. Rep. of Germany | 336/96 |
| 1048044 | 11/1966 | United Kingdom | 174/18 |

OTHER PUBLICATIONS

"Engineering Presentation to AEic/EEI Meter and Service Committees", Hyatt on Union Square, San Francisco, Cal., Apr. 3, 1978, General Electric.

"Transformers for Metering-Only Applications", General Electric, Sep. 1978, *Transmission and Distribution*, p. 70.

*Primary Examiner*—Thomas J. Kozma

*Attorney, Agent, or Firm*—Robert E. Brunson

[57] ABSTRACT

A transformer having diagonally disposed high voltage bushings and core assembly provides a transformer of smaller size than other transformers of a given voltage rating, and a transformer capable of being installed adjacent other transformers of the same construction in a minimum amount of space while maintaining a minimum permissible clearance between the bushing conductors of adjacent transformers.

7 Claims, 6 Drawing Figures

Fig. 3.
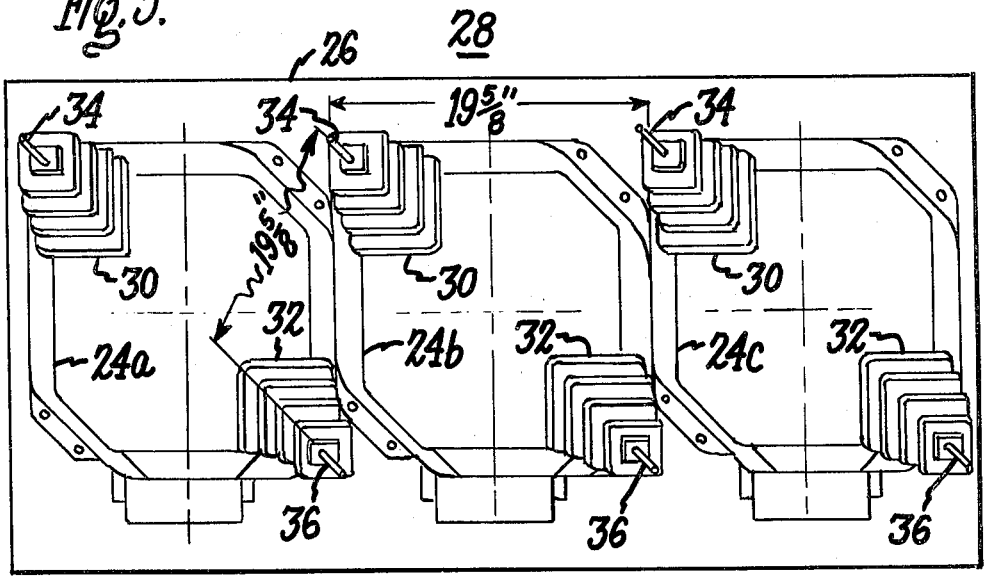
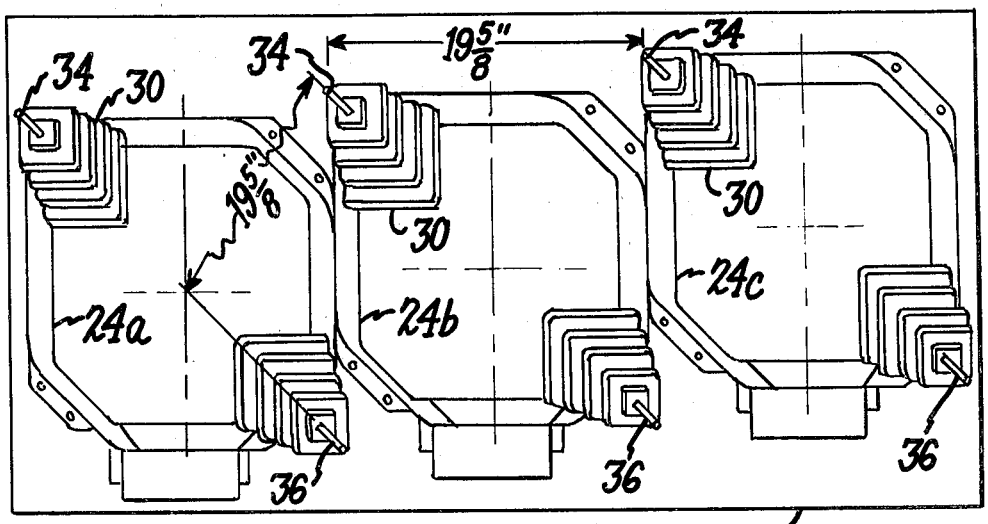
Fig. 4.

80
66
58
56
37
78
104
5
52
100
88a
74
94
98
96
62
60
78
54
82
88b
68
104
24
100
35
92
90
64
76
5

TRANSFORMER CONSTRUCTION

BACKGROUND OF THE INVENTION

1. Field of the Invention

The present invention pertains to electrical apparatus and more particularly to new and improved transformer constructions of economical compact installation space saving design.

2. Description of the Prior Art

Transformer manufacturers are constantly attempting to expand their product line of transformers. One method of doing this is to upgrade existing designs by increasing the voltage ratings of such designs so as to have similar appearing designs, but with a variety of voltage ratings. Generally, upgrading an existing design leads to a much larger transformer, which is costlier from a materials and manufacturing tooling standpoint. Further, as the transformers get larger they require more installation space. The amount of space required to install several transformers adjacent one another can at times be troublesome to the user of such transformers. This is because the user may have only a limited amount of space available, and if a given number of transformers will not fit in that space, he must go to the added expense of enlarging the space or providing a completely new installation area large enough to accommodate the required number of transformers.

It is well known in the high voltage transformer art that the minimum permissible clearance between the transformer bushing conductor terminals of adjacently installed transformers must be increased as the voltage ratings increase. If this minimum clearance is not adhered to, dangerous arcing can occur between the bushing terminals. To achieve this minimum clearance, it is customary to install the transformers further apart so as to further separate the bushing terminals. This, however, requires more installation area as the transformers go up in voltage rating and size.

Therefore, a need exists for a transformer of smaller size and construction which can be economically manufactured and which utilizes the minimum amount of space possible when several transformers are adjacently installed, while maintaining the minimum permissible clearance between the bushing terminals regardless of the voltage ratings of the transformers.

SUMMARY OF THE INVENTION

In its primary context, the electrical apparatus of the present invention provides a transformer construction of such design that two or more transformers can be installed next to one another with little or no clearance between the tanks of the transformers while still maintaining a safe distance between the bushing terminals of the transformers.

The transformer tank construction is substantially rectangular with a matching cover and base for sealing the coil windings and core inside the tank. A pair of high voltage bushings, forming a portion of the transformer, are mounted on diagonally opposite corners of the cover. The bushings extend diametrically outward of the edge of the tank at their respective corners, each at an acute angle with the cover.

By diagonally disposing the bushings in the above manner, a two fold purpose is achieved; (1) a minimum permissible clearance is provided between the diagonally disposed bushings of the transformer, and (2) a minimum permissible clearance is provided between the bushings of closely installed transformers. This latter clearance is made possible because of the relationship of the bushings of adjacent transformers, which when viewed from the top of the transformers, are in a zig-zag relationship instead of being directly opposite or horizontally in-line as in prior art transformer installations. This zig-zag pattern or relationship of the adjacent transformer bushings provides a greater clearance between the bushings for any given distance between the transformer tanks, thus allowing more transformers to be installed in a smaller space than heretofore possible.

The present invention also provides a more economical design than heretofore known by virtue of the orientation of the transformer core with respect to the diagonally disposed bushings and a coil winding which is connected to a conductor extending through each bushing. The core is substantially rectangular in shape and is mounted on the transformer base to extend transversely between the other pair of diagonally disposed corners of the transformer tank and cover so as to lie perpendicular to a center line drawn between the transformer bushings. The coil is disposed on the core structure to provide an overall compact transformer design which allows a smaller transformer to be constructed for a given voltage rating than heretofore possible.

Other improvements in the present invention reside in the implementation of non-conductive and insulative coatings on the coil windings and the configuration or structure of those coatings to eliminate "voltage creep" inside and outside the transformer which can cause arcing or the formation of irregular voltage stress gradients in the transformer.

In view of the foregoing, it is therefore an object of the present invention to provide a new and improved electrical apparatus or transformer construction having enhanced electrical and physical properties.

It is another object of the present invention to provide a transformer construction which allows several transformers to be adjacently installed in a minimum amount of space.

Yet another object of the present invention is to provide a transformer of economical construction of smaller size than other transformers having comparable voltage rating.

BRIEF DESCRIPTION OF THE DRAWING

While the novel features of the invention are set forth with particularity in the appended claims the invention both as to origination and content will be better understood and appreciated along with other objects and features thereof from the following detailed description taken in conjunction with the drawing in which:

FIGS. 2–4 are each plan views looking down on a plurality of transformers of the present invention adjacently installed in several configurations on a ground plane of a transformer mounting station illustrating the reduction in space requirements for the transformers when compared to the prior art installation of FIG. 1.

DETAILED DESCRIPTION OF THE PREFERRED EMBODIMENT

Figure 1:
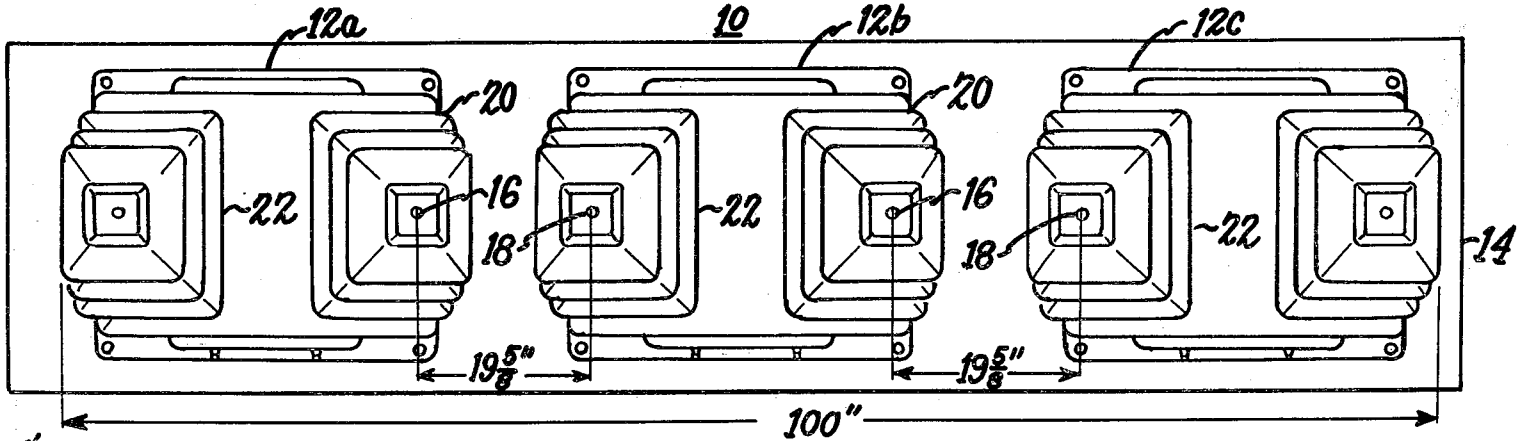
Fig. 1. PRIOR ART
FIG. 1 is a plan view looking down on a plurality of representative prior art transformers adjacently installed on a ground plane of a transformer mounting station.

Referring initially to FIG. 1 there is shown a representative transformer mounting station 10 showing three typical prior art transformers 12*a*, 12*b* and 12*c* installed on a ground plane 14. As illustrated, an assumed minimum permissible clearance of $19\frac{5}{8}''$ ($\approx$49.8475 cm) is shown between conductor terminals 16 and 18 of bushings 20 and 22 of transformers 12*a*–12*c*. Assuming some given length for each of the transformers 12*a*–12*c* and with the clearance shown, a total space or length of 100 inches (245.00 cm) along the ground plane 14 is required to install the transformers 12*a*–12*c*. That which contributes significantly to this overall length, regardless of the size of the transformers, is the fact that the bushings 20 and 22 are directly opposite each other on the transformer center line, making it necessary to spread the transformers further apart to obtain the minimum required clearance between the conductors of the bushings.

Figure 2:
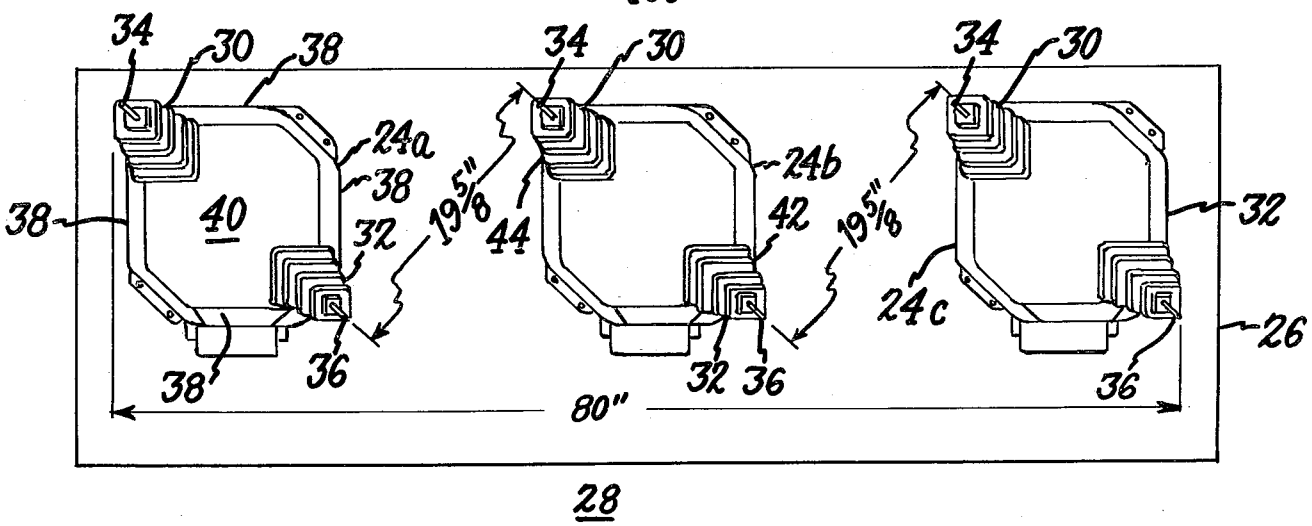

It is the above clearance problem which the invention overcomes by the provision of a transformer construction having diagonally disposed bushings as shown in FIG. 2. In that figure three transformers 24*a*, 24*b* and 24*c* are shown installed on a ground plane 26 of a mounting station 28. Each of the transformers contains two high voltage bushings 30 and 32, with associated conductors or terminals 34 and 36 extending through the respective bushings into the transformer (see FIG. 5).

In the embodiment of FIG. 2, while the overall outside dimensions of the transformers 24*a*–24*c* are smaller than the overall outside dimensions of transformers 12*a*–12*c* of FIG. 1, it should be noted that the spacing between the bushing conductor terminals on each of the transformers 24*a*–24*c* and 12*a*–12*c* is substantially the same. While not shown in FIGS. 1 and 2, this spacing is ideally $19\frac{5}{8}''$, the same as the minimum permissible clearance between the terminals of the adjacently mounted transformers 24*a*–24*c*. The reason that the transformers 24*a*–24*c* can be made smaller and placed closer together than those transformers of FIG. 1 is due to their diagonally disposed bushings and the physical internal and external construction to be described in connection with FIGS. 5 and 6.

In FIG. 2 it can be seen that the bushings 30 and 32 of the adjacently mounted transformers form a zig-zag pattern which allows the transformers to be placed closer together while still maintaining the permissible clearance of $19\frac{5}{8}''$ between the terminals 34 and 36. As shown, this structure provides the capability of installing three or more transformers of equal of unequal voltage ratings to those of FIG. 1 in a much smaller space such as depicted by the 80" (203. cm) between bushings 30 and 32 of transformers 24*a* and 24*c*. This results in a space savings of 20 inches (50.8 cm) compared to the prior art installation of FIG. 1.

Now comparing FIGS. 3 and 4 with FIG. 2, it can be seen that even further space savings is achieved by the transformer construction of the invention. In FIG. 3, the three transformers 24*a*–24*c* are in direct alignment, with their tanks butted together with virtually no space between the transformers. In this embodiment, the same size transformer(s) as that shown in FIG. 2 can be used. However, the height of each of the bushings 30 and 32 would be lengthened to maintain the minimum permissible clearance of $19\frac{5}{8}''$ between the terminals 34 and 36 of the adjacent transformers.

FIG. 4 illustrates another alternative installation whereby the transformers are installed similar to that in FIG. 3, but the transformers are staggered. In this embodiment, the minimum clearance of $19\frac{5}{8}''$ is maintained by physically offsetting the transformers as shown. This embodiment would normally be employed where the small physical size or length of the transformers 24*a*–24*c* and their bushings do not provide the necessary clearance between the bushing terminals 34 and 36 when the transformers are butted next to each other. A small increase in the width of the ground plane 26 is required in this type of installation, however, the additional space requirement is minimal when compared to the long length of the ground plane 14 of FIG. 1.

Figure 5:
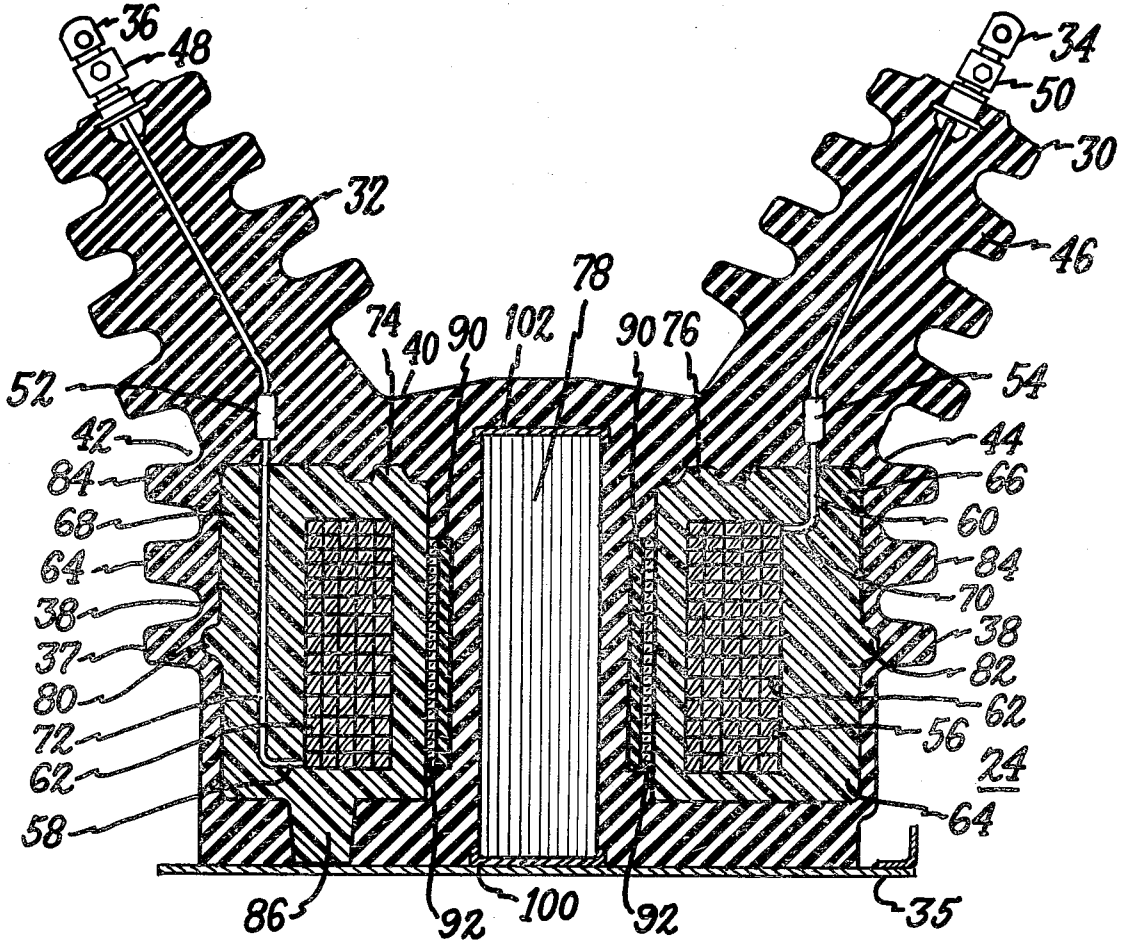
FIG. 5 is a drawing of the transformer of the present invention illustrating the internal structure of the transformer taken in cross-section along lines 5—5 of FIG. 6.
Figure 6:
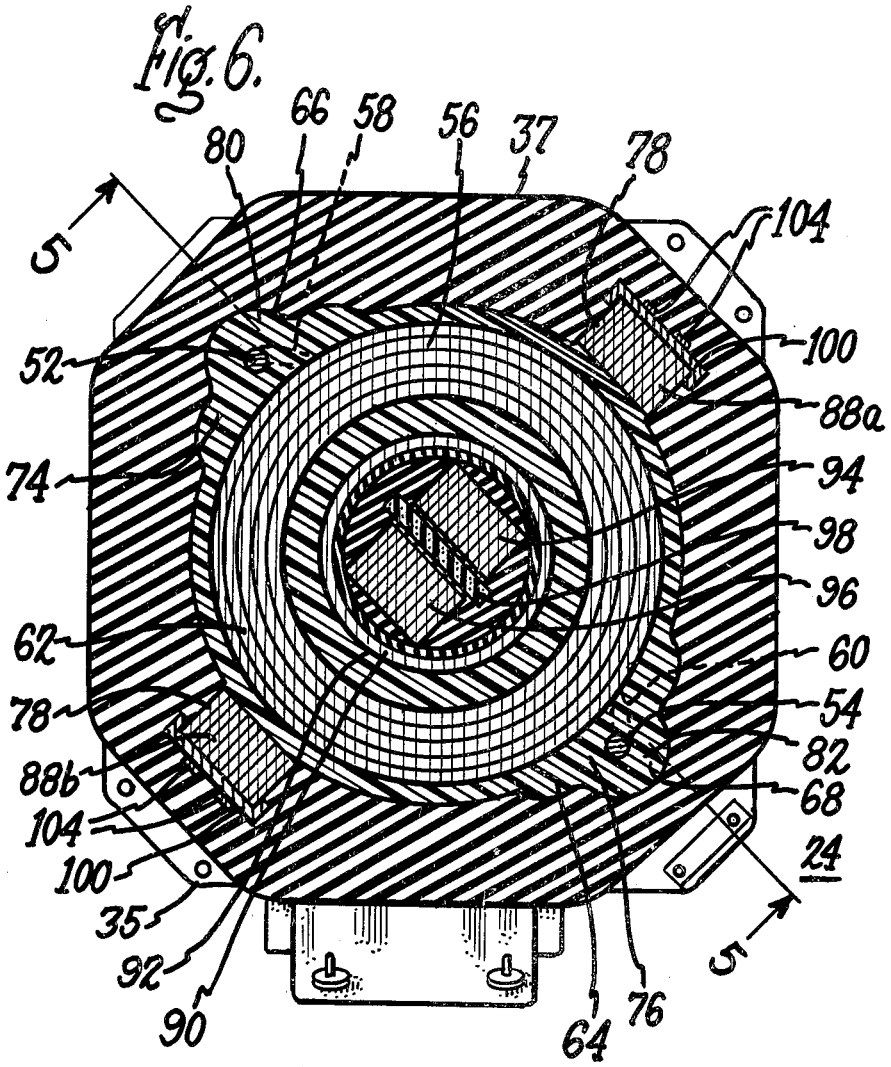
FIG. 6 is a top view of the internal structure of the transformer of the present invention taken in section along lines 6—6 of FIG. 5.

Reference is now made to FIGS. 5 and 6 which illustrate in detail the structure of each of the transformers 24*a*–24*c* (shown as 24) of the present invention. Referring first to FIG. 5, the transformer 24 is shown in cross section cut through lines 5—5 as illustrated in FIG. 6. In this view a substantially rectangular flat metallic base 35 for mounting the transformer serves to enclose the bottom thereof by being in sealing engagement with a tank 37.

In addition to the base 35, tank 37 is comprised of side walls 38 and a cover or top 40 (see FIG. 1). The cover 40 includes the bushings 30 and 32 mounted on first and second diagonally opposite corners of the cover and tank. As shown, the bushings 30 and 32 extend diametrically outward of the tank walls at their respective corners at acute angles with the cover. In the preferred embodiment, the tank, tank cover and bushings are of a unitary construction of injection molded insulative material, such as butyl rubber or the like shown as heavy diagonal lines 46.

Still referring to FIG. 5, the conductors or terminals 34 and 36 extend lengthwise through their respective bushings 30 and 32 with one end of each conductor being exposed at the top of the bushings for connection to a suitable current carrying conductor as shown by connecting means 48 and 50. The other end of each of the conductors 34 and 36 protrudes into the tank and terminates at respective connecting means 52 and 54.

A coil assembly 56, shown as a primary winding, is disposed inside the tank 37 in such a fashion that coil end wires or conductors 58 and 60 are each in substantial alignment with their respective bushings 32 and 30 and connecting means 52 and 54. The coil end wires are electrically attached to the connecting means 52 and 54 to complete the circuit connection from the primary winding 56 to the connectors 48 and 50. This alignment is best seen in FIG. 6.

In the novel construction of the invention, the coil assembly 56 is comprised of many turns of wire 62 (coil windings) which are impregnated in a cast or molded substance of a substantially rigid non-conductive coating or material 64, such as epoxy. As illustrated in FIGS. 5 and 6, the coating 64 surrounds the inner and outer peripheries of the coil 62. It also encapsulates the bottom and top of the coil.

It is significant to note that the Epoxy coating 64 is molded to form two lobes or semicircular members 66 and 68 conjointly with the coil coating. As best shown in FIG. 6, members 66 and 68 lie in the same diagonally disposed plane with the bushings 30 and 32 and their respective conductors 34 and 36. The members 66 and 68 serve basically a two fold purpose: (1) to provide insulation for the conductors 34 and 36 between the coil assembly 56 and the tank 37, and (2) to provide aligning means for orienting the coil and supporting the coil conductors comprised of connecting means 48, 50, 52 and 54, conductor terminals 34 and 36 and coil end wires 58 and 60 disposed in the coating as shown at 70 and 72.

The coating 64 is also formed with electrical creep barriers at strategic points of electrical stress to improve the efficiency and reliability of the transformer. The first of these stress points is shown in FIGS. 5 and 6 as rounded ridges or barriers 74 and 76 on the top of the coil assembly 56. These two barriers are disposed between a core 78 and the diagonally disposed conductors 34 and 36 inside the tank of the transformer. Barriers 74 and 76 serve to increase the physical distance between the core 78 and each of the conductors 34 and 36 to prevent arcing between the core and the conductors.

Two additional barriers 80 and 82 are also formed in the outer periphery of the coating 64 substantially midway between the top and bottom of the coil asembly 56. As best seen in FIG. 6, these two barriers are located at each of the tank corners having the respective lobes 66 and 68 and conform to the outside circular dimensions of those lobes. By locating the barriers 80 and 82 at the points shown, points of concentrated electrical stress are reduced by causing electrical gradients generated by the coil assembly to be evenly distributed along the outer wall of the tank and the epoxy coating.

Referring specifically to FIG. 5, a pedestal 86 is shown forming a part of the casting or coating 64 of the coil assembly. Pedestal 64 also serves a dual function: (1) as a mounting means for leveling the coil assembly to the base 38; and (2) as a heat transfer point for transferring heat from the coil assembly to the base which serves as a heat sink. This latter feature further serves to reduce the overall temperature of the transformer. In FIG. 5, while only one pedestal 86 is shown, it is to be understood that other pedestals could also be disposed around the bottom of the coating 64. The coil assembly of coating 64 may also be formed with a one piece pedestal which circumscribes the bottom of the coil assembly.

The aforementioned core 78, as best illustrated in FIG. 6, is a two piece or split core comprised of two sections 88*a* and 88*b* disposed on the coil assembly 56. A second coil assembly, shown as a secondary, is comprised of a cylinder or form 70 having secondary windings 92. This latter coil assembly is disposed on the core 78 and is circumscribed by the inner insulated wall of the primary coil assembly 56.

As shown in FIGS. 5 and 6, the secondary coil assembly is held disposed on the core by frictional engagement of the inner walls of the cylinder 90 with respective legs 94 and 96 of the core sections 88*a* and 88*b*. This frictional engagement is created at the time of transformer assembly by a wedge or spacer 98 of insulative material which is driven between the core sections 88*a* and 88*b* forcing them into contact with the inner walls of the cylinder 90.

A bracket assembly is provided for solidly mounting the core assembly 78 to the base and secondary assemblies. This bracket assembly is comprised basically of two sections: (1) a first channel member 100 which is welded or otherwise attached to the base 35 to diagonally locate the core at corners opposite the bushings 30 and 32 so that the core is substantially perpendicular to a center line drawn between those bushings.

The channel member is preferably formed into a U shaped structure so as to support and cover at least a portion of the bottom and outer end sections of the core 78. The remaining section of the core bracket assembly is comprised of a second channel member 102 which is in engagement with the top of the core assembly 78. Member 102 lies horizontally across at least a portion of each of the core sections 88*a* and 88*b* so that the entire core bracket assembly can be pulled down with sufficient tension by locking members shown as straps 104. The straps 104, while not completely shown in the drawing, are attached on the ends of the first channel member and drawn up over the top of the core and the second channel member 102 where they are fastened or joined together with sufficient tension on the core bracket assembly to hold the entire core and secondary and primary assemblies in place.

The transformer of the present invention becomes a one piece construction, after it has been molded, to take on a unitary construction whereby all of the voids or clearances beween the various parts of the transformer are filled with the aforementioned butyl rubber as shown by the heavy diagonal lines in FIGS. 5 and 6.

Having described the invention in detail, it can now be seen how the invention, by virtue of its unitary construction, diagonally disposed bushings and core assembly, and its novel primary coil assembly, provides a space saving transformer, and one which can be economically produced and of a smaller size for a given voltage rating than heretofore possible.

While the present invention has been disclosed in connection with a preferred embodiment thereof, it should be understood that there may be other embodiments which fall within the spirit and scope of the invention as defined by the appended claims.

What is claimed is:

1. In an electrical apparatus, the combination comprising:

(a) a generally rectangular tank;

(b) a cover mounted on said tank;

(c) a pair of high voltage bushings mounted on diagonally opposite corners of said cover, with said bushings diametrically extending outward of said tank at their respective corners at acute angles with said cover;

(d) a generally rectangular core assembly mounted inside said tank and extending transversely between the remaining diagonally disposed corners of said tank; and (e) a coil assembly disposed on said core assembly, said coil assembly including a pair of connecting means, each in substantial alignment with a respective bushing and each connected to a conductor extending through its aligned bushing into said tank.

2. The electrical apparatus in accordance with claim 1 wherein said coil assembly is impregnated in a non-conductive molded material and wherein at least a portion of each bushing conductor is rigidly disposed in a lobe of said non-conductive material formed on said coil assembly.

3. The electrical apparatus in accordance with claim 2 wherein a ridge of said non-conductive material is disposed between said core assembly and each connecting means on the top of said coil assembly to increase the distance between said core assembly and each of said connecting means to prevent arcing between said core assembly and each of said conductors.

4. A transformer comprising:

(a) a generally rectangular tank having a matching base and cover, said cover including a pair of high voltage bushings, said bushings being mounted on respective diagonally disposed corners of said cover and said tank, with said bushings diametrically extending outward of said tank at their respective corners at acute angles with said cover, each of said bushings having a conductor extending therethrough with one end thereof protruding into said tank;

(b) a generally rectangular core assembly mounted on said base, inside said tank, and extending transversely between the remaining pair of diagonally disposed corners of said tank; and (c) a coil assembly disposed on said core assembly, said coil assembly including a pair of connecting means, each in substantial alignment with a respective bushing and its conductor, and each connected to the conductor of its aligned bushing.

5. In an electrical apparatus, the combination comprising:

(a) a generally rectangular tank having a cover including a pair of high voltage bushings mounted on diagonally opposite corners of said cover, with said bushings diametrically extending outward of said tank at their respective corners at acute angles with said cover;

(b) a conductor extending through each of said bushings with one end of each conductor extending into said tank;

(c) a generally rectangular core assembly mounted inside said tank and extending transversely between the remaining diagonally disposed corners of said tank; and (d) a coil assembly disposed on said core assembly, said coil assembly having wire ends and being impregnated in a non-conductive molded material with said wire ends rigidly disposed in corresponding lobes formed of said material on said coil assembly, whereby each lobe and its corresponding disposed wire end is in substantial alignment with and connected to a corresponding one of said conductors.

6. A transformer comprising:

(a) a generally rectangular tank having a matching base and cover, said cover including a pair of high voltage bushings, said bushings being mounted on respective diagonally disposed corners of said cover and said tank, with said bushings diametrically extending outward of said tank at their respective corners at acute angles with said cover, each of said bushings having a conductor extending therethrough with one end thereof protruding into said tank;

(b) a generally rectangular core assembly mounted on said base, inside said tank, and extending transversely between the remaining pair of diagonally disposed corners of said tank; and (c) a coil assembly disposed on said core assembly, said coil assembly having wire ends and being molded in a non-conductive material, said coil assembly including, (1) a pair of lobes formed of said material oppositely disposed on the outside surface of said coil assembly with each wire end rigidly disposed in a corresponding one of the lobes, whereby each lobe and its correspondingly disposed wire end is in substantial alignment with and connected to a corresponding one of said conductors, (2) a pair of ridges of said non-conductive material formed on the top of said coil assembly, with each ridge adjacent a corresponding one of said lobes and each ridge disposed between said core structure and its corresponding lobe's connected conductor and wire end to prevent arcing between said core structure and said conductors, and (3) a pedestal of said non-conductive material formed on the bottom of said coil and in contact with the base of said tank for supporting said coil assembly and dissipating heat from said coil assembly into the base serving as a heat sink.

7. The transformer in accordance with claim 6, wherein said core assembly includes means for clamping said core assembly to the base of said tank.

* * * * *